United States Patent [19]

Stegmann

[11] Patent Number: 4,627,500

[45] Date of Patent: Dec. 9, 1986

[54] COAL-COMPACTING POWER-HAMMER ROD ACTIVATOR

[75] Inventor: Heinz Stegmann, Fischbach, Fed. Rep. of Germany

[73] Assignee: Saarberg-Interplan Gesellschaft fur Rohstoff-Energie und Ingenieurtechnik mbH, Saarbrucken, Fed. Rep. of Germany

[21] Appl. No.: 474,634

[22] PCT Filed: Jul. 1, 1982

[86] PCT No.: PCT/DE82/00136

§ 371 Date: Feb. 24, 1983

§ 102(e) Date: Feb. 24, 1983

[87] PCT Pub. No.: WO83/00160

PCT Pub. Date: Jan. 20, 1983

[30] Foreign Application Priority Data

Jul. 1, 1981 [DE] Fed. Rep. of Germany ..... 3125840

[51] Int. Cl.[4] ..... C10R 45/02

[52] U.S. Cl. ..... 173/53; 173/124

[58] Field of Search ..... 173/53–56, 173/124, 123; 91/275

[56] References Cited

U.S. PATENT DOCUMENTS

| | | | |
|---|---|---|---|
| 8,672 | 1/1852 | Goulding | 173/53 |
| 39,768 | 9/1863 | Fowle | 173/53 |
| 942,708 | 12/1909 | Blot | 173/53 |
| 2,593,186 | 4/1952 | Richardson | 173/124 |
| 2,869,824 | 1/1959 | Hazak | 173/124 |
| 3,365,624 | 1/1968 | Komendura | 91/275 |
| 3,500,940 | 3/1970 | Guest | 173/124 |
| 3,565,183 | 2/1971 | Jayne | 173/124 |
| 4,108,610 | 8/1978 | Leibrock | 44/106 |
| 4,176,586 | 12/1979 | Stoll et al. | 91/275 |

*Primary Examiner*—James M. Meister
*Assistant Examiner*—John L. Knoble
*Attorney, Agent, or Firm*—Karl F. Ross; Herbert Dubno

[57] ABSTRACT

In the coking of coking coal according to the compression process the coking coal is compressed by power hammers before its introduction into the coke oven, whereby these hammers having elongated hammer rods are lifted by means of driven cam disks acting upon them by sections, and then released to drop. The cam shafts bearing the cam disks, corresponding to the number of power-hammer rods, are individually pivoted. Their bearing points on both sides of the hammer rods are movable synchronously and in the same direction and are uniformly actuated by a hydraulic system. Thereby, the individual cam shafts can be driven and pressed against the individual power-hammer rods, according to given data. An even and uniform lifting of all rods and power hammers is achieved by that.

7 Claims, 5 Drawing Figures

COAL-COMPACTING POWER-HAMMER ROD ACTIVATOR

CROSS REFERENCE TO RELATED APPLICATIONS

This application is a National Phase application under the Patent Cooperation Treaty of PCT/DE 82/00136 July 1, 1982 and is based under the International Convention and 35 USC 119 upon the German National application P3125 840.9 filed July 1, 1981.

FIELD OF THE INVENTION

The invention relates to a rod actuator for power hammers which are used in compressed-coal coking plants for the compressing of the coking coal before its introduction into the coke oven, actuator having cam-disk shafts running on both sides of the power-hammer rods, the shafts being centrally driven and the cam disks mounted thereon influencing the power-hammer rods in sections.

BACKGROUND OF THE INVENTION

In order to obtain an adequate quality of the coke coking coal can be compacted in specially provided molds by means of power hammers moving up and down. In the compressing devices of German open application 29 14 918 the individual hammers are lifted by cam disks mounted on a throughgoing shaft and actuated by a driving motor. By rotation of both cam disks, these are caused to press in a cam-like protruding area of their circumferences against the web, provided with a friction lining, of the corresponding hammer and lift the hammer due to the effect of the friction force. Upon further rotation the disk cams return to the recessed area of their circumferences and release the power hammer so that it falls and compresses the coking coal.

The cam disks of each side of the power-hammer device have a common shaft per hammer carriage, driven by a gear. On their part, the gears of both shafts are driven by an electromotor through an intermediate gear and a drive unit. The bearings of the shafts are bolted in the frame structure and lined underneath with a stack of shim plates. In order to adjust the cam-disk shafts, the bearings must be dismounted from the frame structure and the shaft can be lifted together with the cam disks and bearings with the purpose of compensating the thickness of the shimming with respect to the degree of wear of the friction lining and to insure the required friction force for lifting the hammer.

The adjustment of the cam-disk shafts is requires to a large expense in effort and time, although it is sufficient, as a rule, to adjust only one of the two shafts. An adequate device, for instance a hoist, is required to lift the cam-disk shaft.

In addition, for each adjustment of the shaft the intermeshing between the cam-disk shaft-pinion and the intermediate gear has to be readjusted. If this operation is not performed scrupulously, damage of the gears through stressing and increased wear is unavoidable. The difficulties are increased by the fact that the required correction of the thickness of the shim package can not be predetermined or foreseen. As a result, in certain cases the adjustment must be repeated, for instance when too many or too thick plates were removed and the bearings are then subjected to unacceptable stress and heat following an increased contact pressure.

In order to keep down-time as low as possible in practice, the cam-disks shaft is adjusted as a rule only then when one or more power-hammer rods are no longer lifted.

In the intermediate stage a slip occurs between the web of the hammer rod and the cam of the disks, due to reduced friction. As a result of the diminished lifting of the power hammer the compression of the coking coal and of the coal cakes to be introduced into the oven for coking are reduced.

In case the operator notices too late, or not at all, that the rods of the hammer have failed to go up, considerable damage can be produced. In this case the unlifted hammers rods remain in the coal cake and are rammed while the carriages are moved forwards by means of a hydraulic cylinder. This can lead to the bending of the power-hammer rods stuck in the solidified coal cake. As a rule, in this case the replacement of the power-hammer rods is unavoidable.

Since the two traversing cam-disks shaft are actuated by a common drive, the cam disks mounted on them can be aligned only together. As a result, each alignment is carried out based on the power-hammer rod whose web and lining thickness are in the worst condition. Only by proceeding in this manner one can be sure that the power-hammer rods are indeed being lifted, since the initial stressing force was based on the most unfavorable situation. However it is also disadvantageous that the remaining cam disks are pressed against the lining with a contact pressure higher than the one needed. The result is a comparatively higher wear of the friction lining.

OBJECT OF THE INVENTION

The object of the invention is to create a device with uniform pressure of the cam disks which works by automatically taking into consideration the variable thicknesses of the web and of the friction lining.

SUMMARY OF THE INVENTION

The object is attained according to the invention by having a number of cam-disks shafts corresponding to the number of the power-hammer rods and individually journaled, whereby their bearing points on both sides of the hammer rods are movable synchronously and in the same direction and can be actuated evenly by a hydraulic system.

Such a construction makes possible a single adjustment of the cam disks and indeed evenly from both sides by aid of servo control. By subdivision of the cam-disk shaft, or shafts, into individual short sections it is possible not only to drive them individually, but also to cause pressing against the friction lining, or webs of the individual hammer rods corresponding to the particular data.

A uniform pressing of the cam disks on both sides of the web is insured by the fact that the bearing points are constructed as rocking arms having intermeshing toothed segments. By influencing one of the bearing points the action is transmitted at the same time also to the other rocking arm and thereby to the other cam disk, so that a uniform load of the web on each side results. The backlash in the meshing of the toothed rocking arms is eliminated according to the invention by two helical springs.

A favorable transmission of the driving forces and a favorable application of the friction forces on the webs of the individual hammer rods is insured according to the invention by the fact that the cam disk is mounted between two rocking arms on the shaft which at the same time carries the cam-shaft pinion. This cam-shaft pinion, according to a further development of the invention, can be coupled with a motor via a distributor wheel and a drive branching. This way it is possible to drive all the cam disks with a single motor, and thereby to lift and drop the individual power-hammer rods uniformly and in a predetermined rythm.

The cam disks are pressed uniformly against the hammer rods via the toothed rocking-arms. In order to keep the necessary efforts related to mechanical, hydraulic and automatic control techniques within limits and at the same time to achieve an even and unidirectional adjustment of the cam disks, the rocking arms according to the invention are moved in the area of the toothed segments, in pairs, each on a lever-shaft, one of said lever-shafts being actuatable or rotatable via a hinged lever and a thereto connected working cylinder. When the lever and by that the lever-shaft are shifted by the cylinder, this motion is transmitted automatically via the toothed segments from one of the rocking arms to the other and this way to both cam disks.

The working cylinder is capable of insuring the same position of the lever-shaft, or the toothed rocking arm and of the cam-disk, or cam disks even when under load, since the hydraulic working cylinder is provided with a releasable relief valve. With the aid of this releasable hydraulic relief valve the oil shock absorber on the side of the piston as well as of the rod can be kept leakproof. In order to balance the operation a pressure tank is provided in the conduit leading to the relief valve. This pressure tank serves as a pressure buffer, maintaining a constant pressure upstream of each of the releasable hydraulic relief valves.

An automatic adjustment of the feeding pressure is advantageously obtained by providing a double-stage pressure switch in the control line on the rod side, which is actuatable via time relay and/or a positioning contact in conjunction with the cam disks. When with the aid of the time relay or the positioning contact it is established that at the cam disks the required initial pressure can not be reached in a given time, an adjustment over the double-stage pressure switch takes place and in the next cycle the optimal initial pressure is insured. The double-stage pressure switch is stimulated via the time relay and the positioning contact.

Shocks in the hydraulic system, which occur especially when the cams of the disks press against the hammer rods are avoided according to the invention in an advantageous and simple way by providing a pressure tank in the control line. It is possible due to this pressure tank, which in accordance to one of the embodiments is inserted advantageously in the control line on the side of the piston, to replace the cam-disk rims, up to now elastically mounted on their hubs, by rigidly mounted cam disks. Such rigidly mounted cam disks are of simpler construction and cheaper and simpler to mount.

The adjustment of the meshing between the pinion of the cam-disks shaft and the intermediate gear is eliminated, since according to the invention the distributor wheel is mounted rotatably on each of the lever-shafts. The distributor wheel, respectively both distributor wheels can always intermesh, independently from the selected counter-pressure and thereby from the position of the cam-shaft pinion.

The invention is characterized especially by the fact that the up-to-know cumbersome adjustment in the operation of several power hammers of one compression mold is eliminated, because now it is possible to select the counterpressure of the individual cam disks each corresponding to the condition of the individual power-hammer rods due to the separate mounting of the cam disks and their individual drive. However the advantage of driving all cam disks via a single drive motor is not being given up. With the aid of the device according to the invention, it is furthermore possible to actuate the individual power-hammer rods uniformly from both sides of the web by the engaging cam disks. Thereby not only a uniform and trouble-free (sic) operation is ensured, but also at the same time a more uniform and always constant compression of the coal cake over the entire length of the compression mold results.

BRIEF DESCRIPTION OF THE DRAWING

Further details and advantages of the device according to the invention result from the following description given with reference to the drawing, in which a preferred embodiment with its details and individual parts is represented. In the drawing.

SPECIFIC DESCRIPTION

Figure 1:
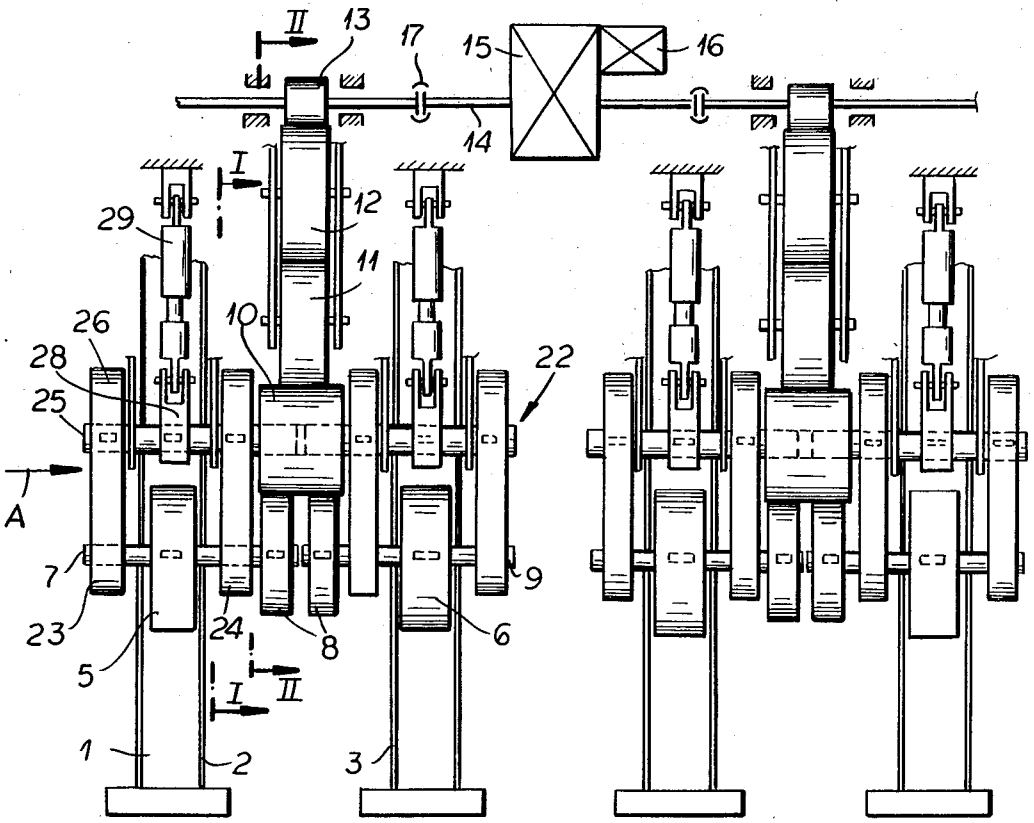
FIG. 1 is a front view of the power-hammer device according to the invention.

The segment shown in FIG. 1 represents a partial view of a power-hammer device with several power hammers 1 functioning in parallel to one another. Each pair of hammer rods 2, 3 are drivewise correspondingly connected, whereby the cam disks 5,6 cooperating with hammer rods 2, 3 serve to lift each of the hammer rods by friction and to let them drop again after the cam disks complete their run.

The cam disks 5, 6 are mounted on short shafts 7, 9 on which the cam-shaft pinions 8 are also mounted. These cam-shaft pinions 8 are connected to the distributor wheel 10, to the intermediate wheels 11, 12 and the drive pinion 13. The driving pinion 13 positioned on the intermediate shaft 14 is actuated by the motor 16 and the gearing 15 and also by the gear coupling 17 positioned therebetween.

The cam disks 5, 6 act upon each web 19, or friction lining 20 of the individual hammer rods 2, 3 with the aid of their cams.

Figure 3:
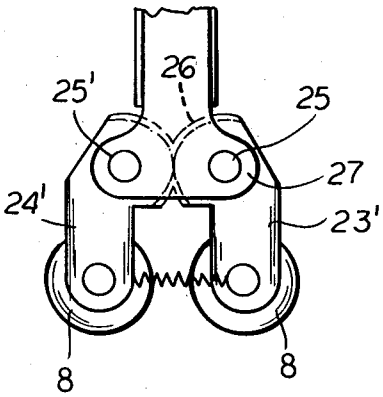
FIG. 3 is a section along line I—I of FIG. 1 showing the displacement of the cam-shaft pinion.
Figure 2:
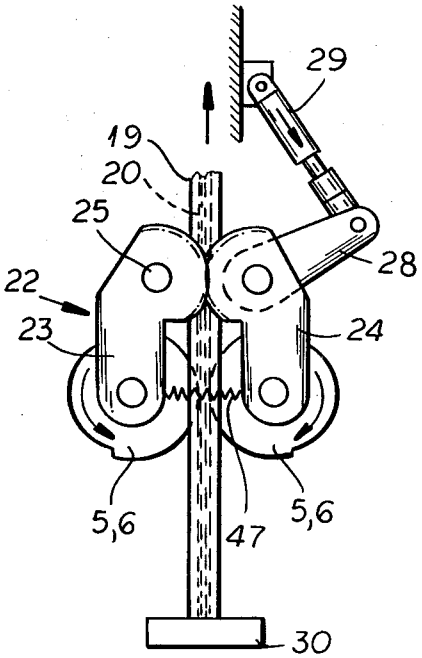
FIG. 2 is a view in the direction of arrow A of FIG. 1 showing the mounting of the cam disks.

The cam shafts are individually pivoted, whereby their bearing members 22 are shaped as intermeshing rocking arms 23, 24 having toothed segments 26. These rocking arms 23, 24 are connected to each other in the area of the toothed segments via a lever shaft 25 in namely in such a manner as shown in FIGS. 1, 2 and 3, according to which the rocking arms 23, 24 are tilted by the actuation of the working cylinder 29 over the lever 28 so that the cam disks 5, 6 either approach the web 19 or are displaced away therefrom.

The lever shafts 25 are maintained on both sides of the power-hammer rods 2, 3 via a common mounting support 27. Only one of the two lever shafts has a lever 28. This is sufficient because the motion of the lever 28 is transmitted to the opposite lever shaft 25' over the toothed segments 26. Correspondingly, the rocking arms 23, respectively 23', as well as 24, respectively 24' follow similar motions. The backlash in the rocking arms 23, 23' and 24, 24' is eliminated by helical springs 47. Thereby a deviation of the teeth during the periodical engagement of the disk cams 41 is avoided. The base of the power hammer, whose dimensions correspond to the ones of the compression mold, is marked 30.

Figure 4:
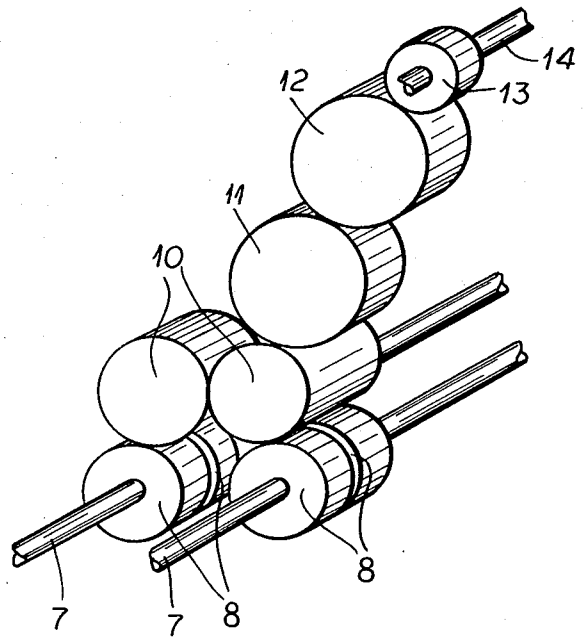
FIG. 4 is a section along line II—II of FIG. 1 showing the position of the drive branching.

The working cylinder 29 moves the lever arm 25 via the lever 28. The rocking arms 23, 24 are then moved synchronously, as mentioned. The cam-disk shaft 9 pivoted between the rocking arms 23, 24, respectively 23', 24' serves at the same time as a carrier of the cam disks 5, 6 and shaft pinion 8. The cam disks 5, 6 are set in operational position via the cam-disk shaft 9. The adjustment of the cam disks 5,6 is carried out by the hydraulic system. In FIG. 4 the drive of the cam-shaft pinion 8 is shown, whereby the individual transmission gears are marked 10, 11, 12, 13.

Figure 5:
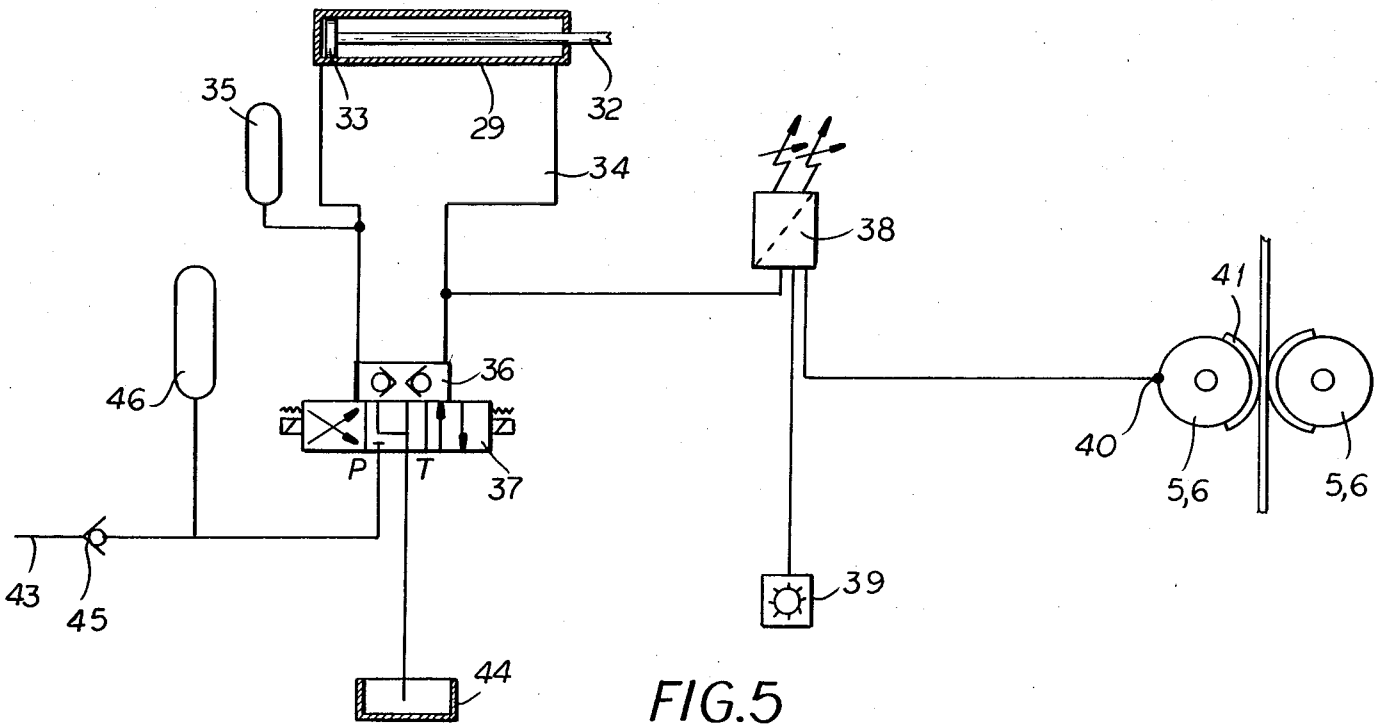
FIG. 5 is a schematic representation of the hydraulic control system.

FIG. 5 shows the diagram of hydraulic connections, whereby the working cylinder 29 has a special control system through which the position of the piston rod 32 and of the piston 33, respectively their fixation is reached. In the control line 34 a pressure reservoir 35 is provided which acts as a compensator and absorbs the shocks in the hydraulic system, shocks which unavoidably occur when the disk cams 41 pressagainst the hammer rods 2, 3. This way, rigidly mounted cam disks 5, 6 can be used, their manufacturing and mounting being considerably simpler and cheaper than the previous constructions. Also, in this case heavier power-hammer rods can be used, if needed, and thereby higher amounts of energy can be applied to the coal cake in the amount of compression time.

The working cylinder 29 is shaped and connected in such a manner that even in the desired rest position a shifting due to an outside force, as for instance the hobbing force of the cam disks is not possible. Even during extended rest periods, the working cylinder 29 which is under load will not creep, as the oil shock absorber on the piston side as well as on the rod side can be leakproofed by the check valve/releasable hydraulic relief valve 36, 37. A double-stage pressure switch 38 which can be set for a minimal and maximal initial pressure of the cam disks 5, 6 is stimulated via time relay 39. Such is the case when after a pretermined time span, as for instance 2 minutes the minimal value is not reached. The maximal value of the prestress of the cam disks is reached when the working cylinder 29 extends so far that the maximal pressure preset in the double-stage switch 38 applies. This adjustment of the cam disks 5, 6 takes place when the positioning contact 40 is juxtaposed to the disk cam 41. This adjustment is required according to the invention every one to two months.

The pressure reservoir 46 which is provided in the conduit 43 connected to the storage tank 44 and located behind the relief valve 45 functions as a pressure buffer.

I claim:

1. A coke compactor comprising:

a plurality of power hammers adapted to be raised and dropped to compact coke, each of said hammers being provided with an upstanding rod having a web;

a respective actuator for each of said hammers, each of said actuators comprising:

a pair of cams flanking a web of a respective rod of the respective hammer and bearing against said web, said cams being formed along their periphery with surfaces frictionally entraining the respective web upwardly and surfaces which release the respective web to permit the respective hammer to drop, respective levers flanking the respective rod rotably carrying said cams, said levers being formed with mutually meshing gear segments whereby the displacement of one lever about a fulcrum constituting an axis of one gear segment causes the other lever to swing oppositely and synchronously for controlled application of said cams against the respective web, a respective fluid-operated cylinder operatively connected to one of said levers for controlling the force with which said cams are applied against the respective web, and respective pinions operatively connected to said cams; and a common drive for all of said actuators, said drive including a gear train meshing with said pinions.

2. The coke compactor defined in claim 1, further comprising a hydraulic circuit supporting said cylinder and including a relief valve and a control valve.

3. A coke compactor comprising:

a plurality of power hammers adapted to be raised and dropped to compact coke, each of said hammers being provided with an upstanding rod having a web;

a respective actuator for each of said hammers, each of said actuators comprising:

a pair of cams flanking a web of a respective rod of the respective hammer and bearing against said web, said cams being formed along their periphery with surfaces frictionally entraining the respective web upwardly and surfaces which release the respective web to permit the respective hammer to drop, respective levers flanking the respective rod rotatably carrying said cams, said levers being formed with mutually meshing gear segments whereby the displacement of one lever about a fulcrum constituting an axis of one gear segment causes the other lever to swing oppositely and synchronously for controlled application of said cams against the respective web, a respective fluid-operated cylinder operatively connected to one of said levers for controlling the force with which said cams are applied against the respective web, and respective pinions operatively connected to said cams;

a common drive for all of said actuators, said drive including a gear train meshing with said pinions;

a hydraulic circuit supporting said cylinder and including a relief valve and a control valve; and a pressure accumulator disposed upstream of said relief valve.

4. The coke compactor defined in claim 3, further comprising a 2-stage pressure switch respective to a delay in a pressure buildup in said circuit and to excess pressure development therein.

5. The coke compactor defined in claim 4, further comprising a pressure reservoir between said valve and said cylinder.

6. The coke compactor defined in claim 1 wherein each of said gear trains includes a distributor gear meshing with the respective pinion and rotatable about an axis coinciding with the respective fulcrum.

7. The coke compactor defined in claim 1, further comprising coil springs braced between said levers for eliminating backlash in said gear segments.

* * * * *